US008086151B2

(12) United States Patent
Nishikawa et al.

(10) Patent No.: US 8,086,151 B2
(45) Date of Patent: Dec. 27, 2011

(54) DEVELOPING ROLLER SPECIFIC FOR MONO-COMPONENT DEVELOPING APPARATUS

(75) Inventors: Tomoharu Nishikawa, Hirakata (JP); Toshihide Taniguchi, Chiyoda-ku (JP); Toshiyuki Sakai, Chiyoda-ku (JP); Norikazu Okabe, Toyokawa (JP); Hiromasa Ueno, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 812 days.

(21) Appl. No.: 12/115,017

(22) Filed: May 5, 2008

(65) Prior Publication Data

US 2008/0310889 A1 Dec. 18, 2008

(30) Foreign Application Priority Data

Jun. 12, 2007 (JP) ..... 2007-155025

(51) Int. Cl.
*G03G 15/08* (2006.01)

(52) U.S. Cl. ..... 399/279; 399/103; 399/105; 399/286

(58) Field of Classification Search ..... 399/103, 399/105, 279, 286
See application file for complete search history.

(56) References Cited

FOREIGN PATENT DOCUMENTS

| | | | |
|---|---|---|---|
| JP | 04-104277 | | 4/1992 |
| JP | 2000242073 A | * | 9/2000 |
| JP | 2003-186299 (A) | | 7/2003 |
| JP | 2008-189749 | | 7/2005 |

OTHER PUBLICATIONS

The First Office Action issued in corresponding Chinese Application No. 2008101114112 dated Oct. 16, 2009, and an English Translation thereof.
Notification of Reasons for Refusal in JP 2007-155025 dated Apr. 21, 2009, and an English Translation thereof.
Notification of Reasons for Refusal with English Translation, Japanese Patent Application No. 2007-155025, dated Jul. 14, 2009.

* cited by examiner

*Primary Examiner* — David Gray
*Assistant Examiner* — Laura Roth
(74) *Attorney, Agent, or Firm* — Buchanan Ingersoll & Rooney PC

(57) ABSTRACT

A mono-component developing apparatus including a developing roller which transports toner supported on an outer circumferential face of a center portion toward a developing area by rotating while frictionally sliding on a sealing member on each of two end portions. The developing roller includes surface processing areas having a spiral shape, placed on each of outer circumferential faces of the two end portions. An angle, made by a spiral direction of each surface processing area and the rotation direction, is an acute angle. The developing roller inhibits toner leakage, with the driving torque of the developing roller being only slightly increased.

10 Claims, 7 Drawing Sheets

DEVELOPING ROLLER SPECIFIC FOR MONO-COMPONENT DEVELOPING APPARATUS

This application is based on application(s) No. 2007-155025 filed in Japan, the contents of which are hereby incorporated by reference.

BACKGROUND OF THE INVENTION

1. Field of the Invention

The present invention relates to a mono-component developing apparatus and a developing roller to be used in such a developing apparatus. In particular, the developing roller of the present invention is classified as a hard roller without a foamed material layer.

2. Description of the Related Art

In a mono-component developing apparatus, an electrostatic latent image on a latent-image-bearing member is visualized by using a mono-component developer made from toner, through an electro-photographic system. In a two-component developing apparatus, an electrostatic latent image is visualized by using a two-component developer made from toner and a carrier. In the mono-component developing apparatus, upon transporting the toner to a developing area by the rotation of the developing roller, different from the two-component developing apparatus, no magnetic force can be utilized, and since the toner is not sufficiently held, a problem arises in which toner leakage occurs due to toner movements toward the developing-roller axis direction.

In order to prevent the toner leakage in the mono-component developing apparatus, as shown in FIG. 6, a technique has been known in which a developing roller 100 is allowed to rotate while frictionally sliding on a sealing member 101 on each of the two end portions. In this technique, the frictionally sliding area on the sealing member on each of the two end portions of the developing roller 100 is evenly subjected to the same treatment as that of the toner supporting area in the center portion, and, for example, a blasting treatment or a coating treatment is evenly carried out over the entire frictionally sliding area. However, toner is intruded into a gap between each of the two end portions of the developing roller and the sealing member to cause toner fusion, failing to sufficiently prevent toner leakage.

In order to solve this problem, with respect to the developing roller in which the metal core shaft is coated with resin, a structure in which the sliding area on the sealing member on each of the two end portions is not resin-coated has been proposed (Japanese Patent Application Laid-Open No. 2003-186299). With this arrangement, the intrusion of toner between the developing roller and the sealing member can be prevented so that it becomes possible to prevent toner leakage.

However, in the above-mentioned developing roller, since the adhesion between the developing roller and the sealing member become high, a new problem is raised in which the driving torque of the developing roller is raised extremely.

BRIEF SUMMARY OF THE INVENTION

The objective of the present invention is to provide a developing roller which makes it possible to sufficiently prevent toner leakage, with the driving torque of the developing roller being scarcely increased, and a mono-component developing apparatus having such a developing roller.

The present invention relates to a developing roller for a mono-component developing apparatus, which transports toner supported on an outer circumferential face of the center portion toward a developing area by rotating while frictionally sliding on a sealing member on each of two end portions, and is provided with surface processing areas having a spiral shape, placed on each of outer circumferential faces of the two end portions, and in this structure, an angle, made by a spiral direction of the surface processing area and the rotation direction, is allowed to have an acute angle.

DESCRIPTION OF THE PREFERRED EMBODIMENT

Embodiment of the present invention will be described in the following.

Figure 1:
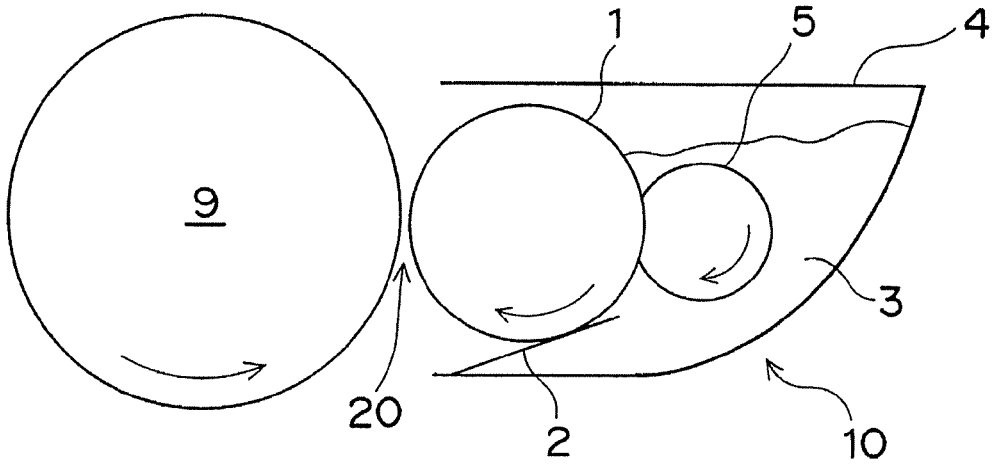
FIG. 1 is a schematic structural view that shows one example of a developing apparatus in accordance with the present invention.

A mono-component developing apparatus (hereinafter, referred to as developing apparatus) in accordance with the present embodiment is provided with a specific developing roller which transports toner supported on a circumferential face of the center portion to a developing area by rotating while frictionally sliding on a sealing member on each of two end portions. Normally, as shown in FIG. 1, such a developing apparatus 10 is provided with not only the corresponding developing roller 1, but also a regulating blade 2 that regulates the toner on the developing roller 1, and is used for charging the toner, and a developer vessel 4 that houses the regulating blade 2, the developing roller 1 and the toner 3, and, if necessary, is further provided with a supplying roller 5 used for supplying the toner 3 to the developing roller 1. In the developing apparatus 10, the developing roller 1 supports the toner on its outer circumferential face, and transports the toner to the developing area 20 so that an electrostatic latent image on a latent-image bearing member 9 is visualized. FIG. 1 is a schematic structural view that shows one example of a developing apparatus of the present invention.

In the present embodiment, the developing roller 1 is classified as a so-called hard roller, which is formed by carrying out a surface treatment on a metal core shaft made of iron, aluminum and the like. More specifically, as shown in FIG. 2A, the developing roller 1 is designed to transport toner supported on an outer circumferential face of a center portion 12 toward a developing area by rotating in the rotation direction x, while frictionally sliding on a sealing member on each of two end portions 11 (11*a* and 11*b*), and is provided with surface processing areas 13 having a specific shape, placed on each of outer circumferential faces of the two end portions 11.

Figure 2A:
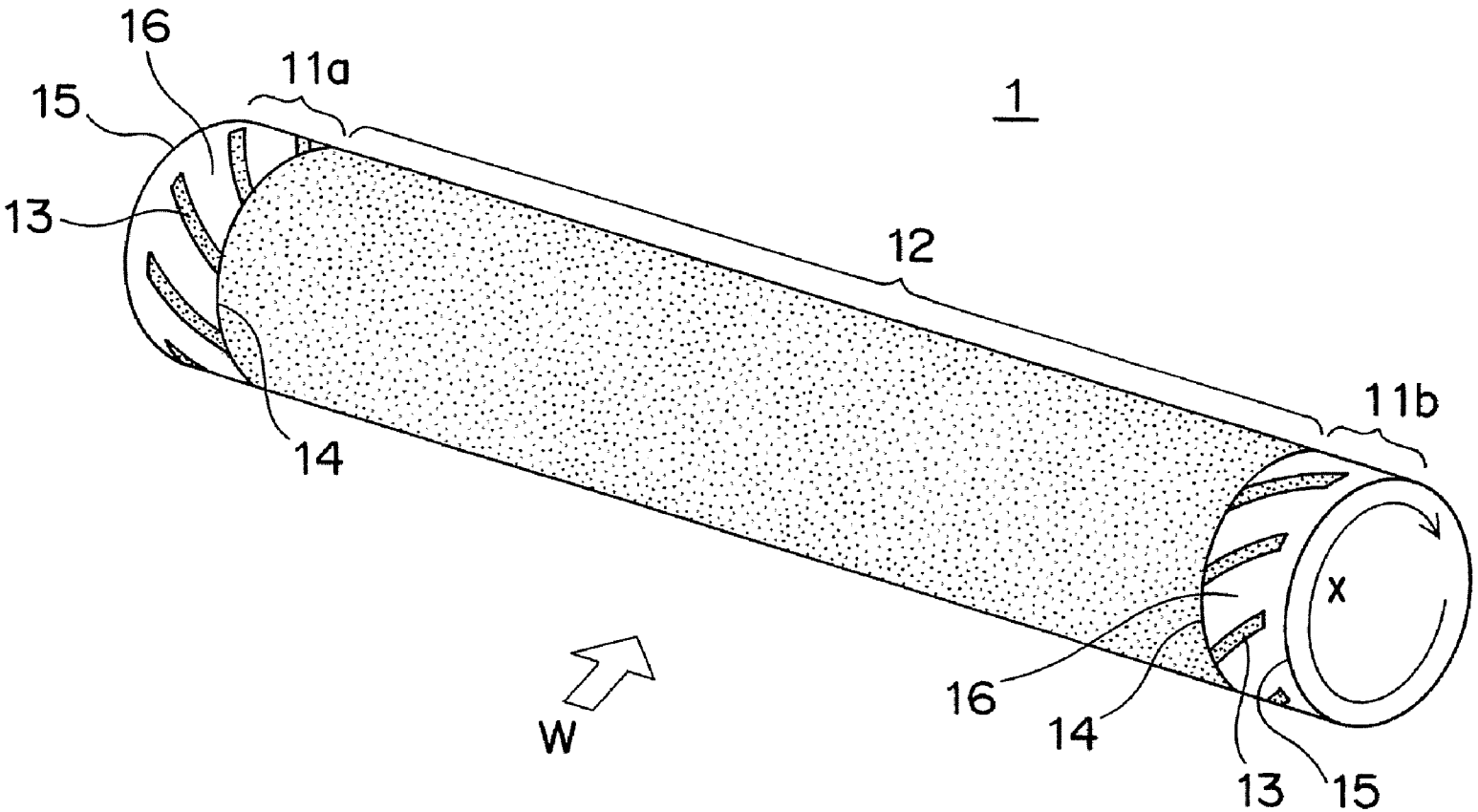
FIG. 2A is a schematic sketch that shows one example of a developing roller in accordance with the present invention.

FIG. 2A is a schematic sketch showing one example of a developing roller relating to the present embodiment.

Figure 2B:
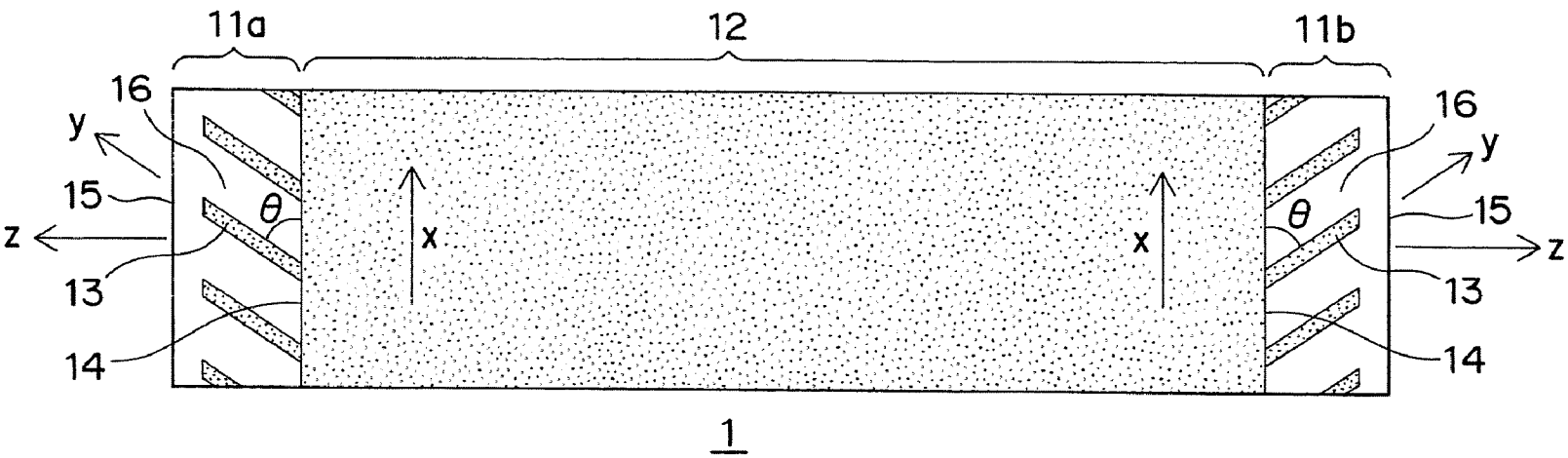
FIG. 2B is a schematic sketch that shows the developing roller of FIG. 2(A) viewed in a direction of w.

The surface processing areas 13 which the developing roller 1 has on its outer circumferential faces of the two end portions 11 (11*a*, 11*b*) have a spiral shape on each outer circumferential face, as shown in FIG. 2A, and an angle, made by the spiral direction of each surface processing area 13 and the rotation direction, is set to an acute angle. The expression that the surface processing areas have a spiral shape means that the surface processing areas 13 are formed into a helical shape like grooves that a screw possesses on the outer circumferential face of the developing roller 1. More specifically, as shown in FIG. 2B, the spiral direction refers to an extending direction y of each surface processing area 13 that is formed in a manner so as to extend toward the end face 15 of the developing roller 15 from the end portion 14 of the center portion 12 that forms a toner transporting area of the developing roller 1. FIG. 2B is one portion of a schematic development that shows the developing roller of FIG. 2A viewed in a w direction, and explains the spiral direction y, the rotation direction x and the angle θ made by these directions. In the schematic development shown in FIG. 2B, each of the surface processing areas 13 is linearly formed; however, strictly speaking, it may be formed into a curved shape. In this case, at the intersection point between the border line on the downstream side in the rotation direction x, which forms each surface processing area having the curved shape, and the end portion 14 of the center portion 12, the extending direction with respect to the tangent of the corresponding border line forms the spiral direction y. In the present embodiment, as shown in FIG. 2B, the angle θ, made by the above-mentioned spiral direction y and the rotation direction x, is set to an acute angle. In other words, the spiral direction y of each surface processing area 13 is tilted toward the rotation direction x side from the axis direction z of the developing roller 1. In order to precisely find the angle θ, an angle made by the spiral direction y and the rotation direction x can be found from the development of the developing roller. The angle θ is not particularly limited as long as the objective of the present invention can be achieved, and is preferably set in the range from 5° or more to 80° or less, more preferably, from 7° or more to 70° or less.

In the present embodiment, the developing roller 1 is provided with the surface processing areas 13 having a spiral shape on the peripheral face of each of the two end portions thereof, and the developing roller 1 is rotated in such a manner that the angle θ, made by the spiral direction y of each surface processing area 13 and the rotation direction x, is allowed to have an acute angle. With this arrangement, it is possible to sufficiently prevent toner leakage with hardly any increase in the driving torque of the developing roller. More specifically, even in the case when such a developing roller is allowed to rotate while frictionally sliding on the sealing member at each of the two end portions thereof, the adhesion between the surface of the developing roller and the sealing member does not become too high because of the presence of the surface processing areas 13 having the spiral shape; thus, it is possible to sufficiently prevent an increase in the driving torque of the developing roller. Even in the case when toner is intruded into the gap between the surface of the developing roller and the sealing member, a function for returning the toner toward the center portion 12 is exerted by the rotation since the angle θ is an acute angle. Because of these functions, it is possible to effectively prevent the toner leakage. For example, when the same treatment as that of the toner-bearing area in the center portion is evenly carried out over the entire faces of the two end portions 11 of the developing roller 1, it is not possible to sufficiently prevent toner leakage. In the case when no treatment is carried out over the entire faces of the two end portions 11 of the developing roller 1, the adhesion between the sealing member and the developing roller becomes higher, resulting in an extreme increase in the driving torque. If the angle θ made by the spiral direction y of each surface processing area 13 and the rotation direction x was an obtuse angle, or, if the rotation direction of the developing roller was reversed to the direction x, for example, as shown in FIG. 2B, toner, intruded into the gap between the surface of the developing roller and the sealing member, would rather be shifted toward each of the end faces 15 of the developing roller, with the result that the possibility of toner leakage becomes higher. Even when the angle θ is set to 90°, it is not possible to sufficiently prevent the toner leakage.

The surface processing areas 13 are areas having a different surface state in the surface roughness, surface height and the like from the area 16 other than the surface processing areas 13 (hereinafter, referred to as "the other area") in each of the two end portions 11.

In the case when the surface roughness of the surface processing areas 13 is different from that of the other area 16, not particularly limited as long as the objective of the present invention is achieved, the difference in the surface roughness between these areas may be normally set to 3 μm or more, in particular, 3 to 15 μm. From the viewpoint of more sufficiently preventing toner leakage, the difference in the surface roughness is more preferably set in the range from 5 to 15 μm. In the present embodiment, normally, the surface roughness of the surface processing areas 13 is made greater than that of the other area 16. In the present embodiment, for example, the surface roughness of the surface processing areas 13 is normally set in the range from 6 to 15 μm, while the surface roughness of the other area 16 is normally set in the range from 0.5 to 2 μm. By the difference in the surface roughness between the surface processing areas 13 and the other area 16 and the function of the above-mentioned angle θ, the function for returning toner intruded into the gap between each of the end portions 11 and the sealing member toward the center portion 12 is exerted more effectively so that the toner leakage restraining effect becomes greater.

The above-mentioned difference in the surface roughness can be formed by using a blasting process. For example, the surface processing areas 13 are formed through the blasting process, and the other area 16 is normally not subjected to the blasting process, but may have a mirror-face. The mirror face refers to a face having a surface roughness of 2 μm or less, in particular, 1 μm or less.

The blasting process is a process in which a blasting medium, such as glass beads, SUS beads and alumina beads, having a particle size of several tens of μms, is made to collide with a predetermined area at high speeds. The surface roughness of the processing area can be controlled by adjusting hardness, colliding speed, particle size and the like of the medium.

The surface roughness is indicated by an average roughness (Rz) of ten points, and the value obtained by the following method is used. That is, a contact-type surface roughness shape measuring machine, which is based upon the tracer method, is used. This measurement can be made, for example, by a surface roughness shape measuring machine Surfcom 480A, made by Tokyo Seimitsu Co.

In the case when the surface height of the surface processing areas 13 is different from that of the other area 16, although not particularly limited as long as the objective of the present invention is achieved, the difference in the surface height between these areas may be normally set to 5 μm or more, in particular, in the range from 5 to 30 μm. From the viewpoint of more sufficiently preventing toner leakage, the difference in the surface height is more preferably set in the range from 5 to 20 μm. In the present embodiment, normally, the surface height of the surface processing areas 13 is made higher than that of the other area 16. By the difference in the surface height between the surface processing areas 13 and the other area 16 and the function of the above-mentioned angle θ, the function for returning toner intruded into the gap between each of the end portions 11 and the sealing member toward the center portion 12 is exerted more effectively so that the toner leakage restraining effect becomes greater.

The above-mentioned difference in the surface height can be formed by using a resin coating process. For example, the surface processing areas 13 are formed through the resin coating process, and the other area 16 is normally not subjected to the resin coating process, but may have a mirror-face.

The resin coating process is a process in which a solution, prepared by dissolving a resin in a solvent, is applied to a predetermined area and dried thereon. The amount of coating, the viscosity of the solution, the coating rate and the like are adjusted so that the surface height of the processing areas can be adjusted; thus, the difference in the surface height can be controlled.

With respect to the resin, not particularly limited, examples thereof include: urethane resin (including a urethane resin containing fluorine atoms), silicone resin, polyester resin, poly(meth)acrylate resin and styrene-(meth)acrylate copolymer resin. In particular, with respect to the material for a resin coating layer containing a urethane resin, a polyol component and an isocyanate component are used, and with respect to the polyol component, a fluorine-atom containing polyol is preferably used. Specific examples of the fluorine-containing polyol include a copolymer polyol made by using ethylene trifluoride monomer as a main raw material, and a copolymer polyol made by using ethylene tetrafluoride monomer as a main component. These fluorine-containing polyols are commercially available, and, for example, ZEFFLE (made by Daikin, Inc.), LUMIFLON (made by Asahi Glass Industries) and DEFENSA (made by Dainippon Ink & Chemicals, Inc.) and the like may be used. Preferable examples of the isocyanate component include diisocyanate, such as diphenylmethane diisocyanate (MD) and tolylene diisocyanate (TDI), urethane-modified diisocyanate, and alcohol-modified diisocyanate. With respect to the urethane-modified diisocyanate, for example, DURANATE (made by Asahi Kasei Kogyo) may be used, and with respect to the alcohol-modified diisocyanate, for example, COSMONATE (made by Mitsui Takeda Chemicals, Inc.) may be used.

Additives such as roughness-providing particles and a conductive substance may be dispersed in the resin coating layer.

With respect to the roughness-providing particles, organic particles or inorganic particles that are insoluble to a solvent may be used. Specific examples of the organic particles include acrylic resin particles and silicone resin particles and the like. Specific examples of the inorganic particles include metal oxide particles such as silica particles and titania particles.

With respect to the conductive substance, not particularly limited as long as it imparts a conductive property to the coating layer, examples thereof include carbon black and metal particles. Preferably, carbon black is used.

With respect to the solvent, not particularly limited as long as it can dissolve the resin, examples thereof include organic solvents, such as butyl acetate, ethyl acetate, xylene and toluene.

With respect to the coating method, not particularly limited, methods, such as a dipping method, a spray coating method, a roll coater method and a brush coating method, may be used.

With respect to the drying method, methods, such as an air-drying method in which the layer is naturally dried, a drying method in which air is forcefully applied to the layer and a heat drying method, may be used.

With respect to the surface processing method for the surface processing areas 13, the same method or different methods may be used between the end portion 11*a* and the end portion 11*b*; however, from the viewpoint of manufacturing costs, the same process is preferably carried out.

Figure 3:
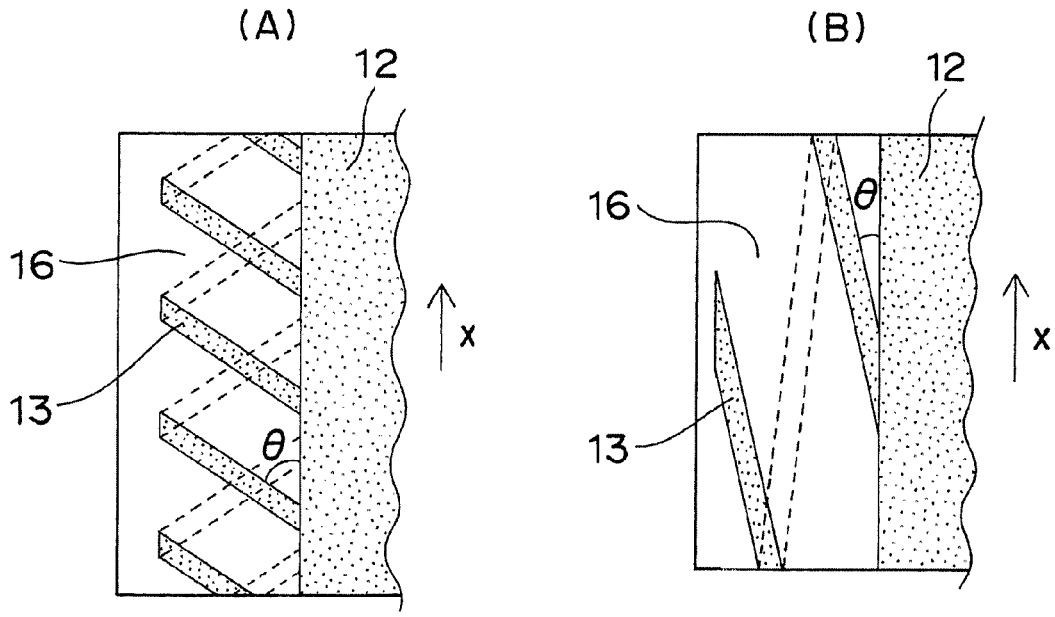
FIGS. 3(A) and 3(B) are schematic views each of which shows a specific example of surface processing areas on one end of the developing roller.

The developing roller may be provided with one or more number of surface processing areas 13 having a spiral shape per one end portion, and from the viewpoint of balance between the manufacturing costs and the toner leakage prevention, for example, in the case of 16 mm of the outer diameter of the developing roller, the number is preferably set in the range from one to eight. For example, FIG. 3(A) shows an example having eight surface processing areas 13 on one end portion of the developing roller, and FIG. 3(B) shows an example having one area. In FIGS. 3(A) and 3(B), broken lines indicate surface processing areas 13 that are not visible.

Figure 4:
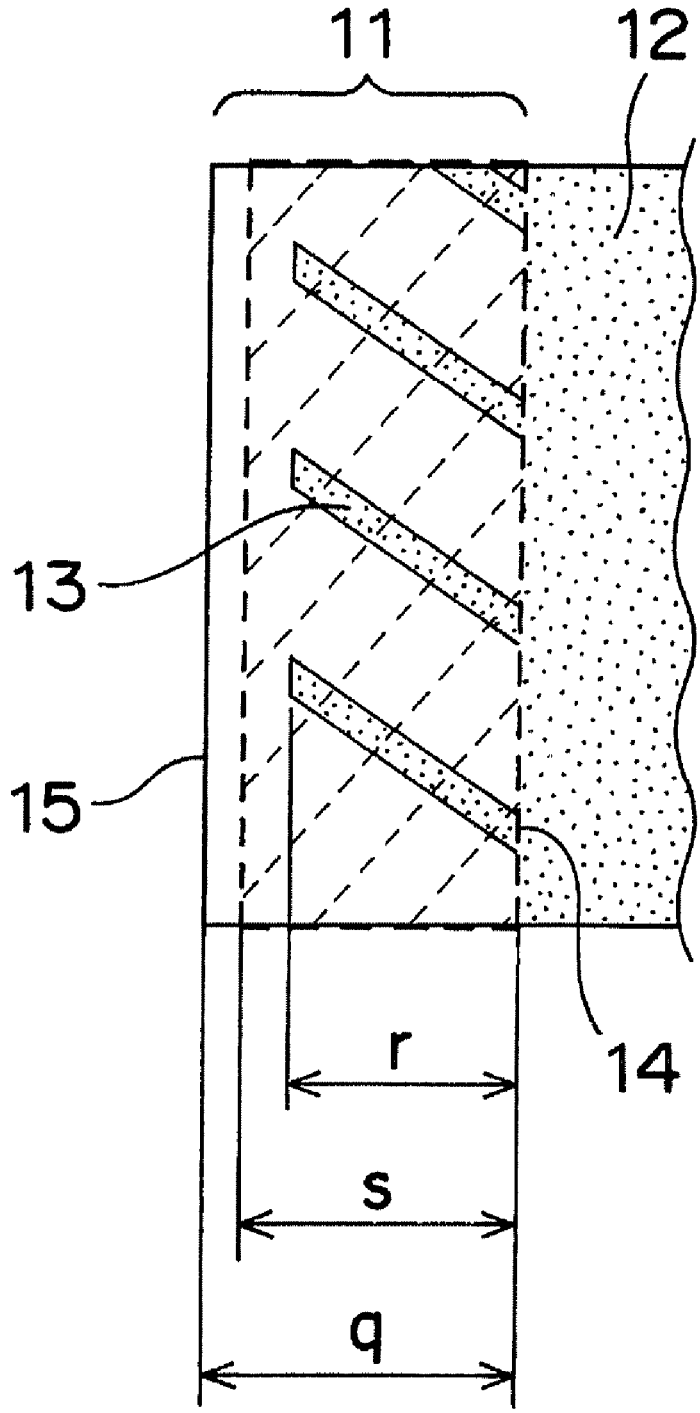
FIG. 4 is a schematic view that explains the shape and dimension of the surface processing areas on an end portion of the developing roller.

The dimensions of the surface processing areas 13, the end portion 11 having the corresponding areas and the sealing member are not limited as long as the objective of the present invention is achieved; however, the following relationship is preferably satisfied. With respect to the axis direction of the developing roller, as shown in FIG. 4, supposing that the distance from the end portion 14 of the toner supporting area in the center portion 12 to the end face 15 of the developing roller is q, that the length of the surface processing areas 13 having a spiral shape is r, and that the frictional contact area of the end portion 11 of the developing roller to the sealing member (area with slanting broken lines) is s, the following relational expression is preferably satisfied:

$$q \geqq s > r, \text{ in particular, } q > s > r.$$

With this arrangement, the toner leakage can be prevented further effectively. In FIG. 4, the frictional contact area (area with slanting broken lines) of the end portion 11 to the sealing member is just adjacent to the center portion 12 (toner supporting area); however, the present invention is not limited to this, and these areas may be partially overlapped with one another.

The dimensions of q, r and s are not particularly limited, and appropriately determined depending on, for example, the dimension of the developing roller, the dimension of the photosensitive member and the dimension of the image area. Normally, in the case of an A-4 longitudinal feeding printer, q is set in the range from 10 to 15 mm, r is set in the range from 6 to 10 mm and s is set in the range of 8 to 12 mm in the case when the length in the axis direction of the developing roller is in the range from 230 to 250 mm.

Figure 5:
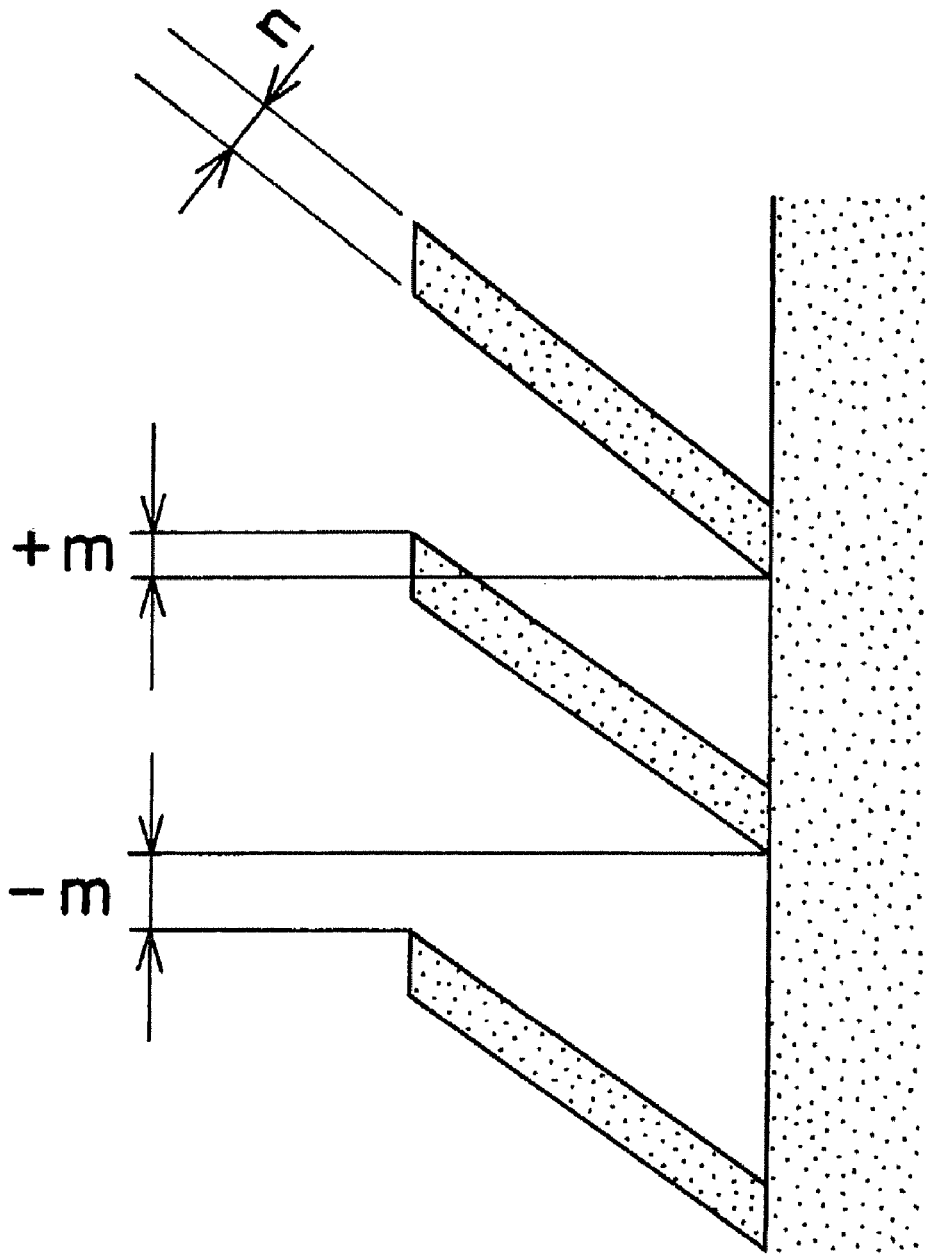
FIG. 5 is a schematic view that explains the shape and dimension of the surface processing areas on an end portion of the developing roller.

With respect to the width of the surface processing areas 13, not particularly limited as long as the above-mentioned angle θ is achieved, it is normally determined depending on the outer diameter of the developing roller, the number of the surface processing areas and the like. For example, in the case when the outer diameter of the developing roller is 16 mm and the number of the surface processing areas is 1 to 8 per one end portion of the developing roller, the width n, as shown in FIG. 5, is normally set in the range from 0.5 to 5 mm. From the viewpoint of more effectively preventing the toner leakage, n is preferably set in the range from 0.5 to 2.5 mm. In the case when two or more surface processing areas 13 are provided per one end portion of the developing roller, the width of the other area 16 between the adjacent surface processing areas 13 is not particularly limited.

In the case when two or more surface processing areas 13 are provided per one end portion of the developing roller, the adjacent surface processing areas 13 may be overlapped with each other in the axis direction of the developing roller. For example, the overlapped amount m, indicated by "+m" and "−m" as shown in FIG. 5, is normally set in the range from −2 to +2 mm, in particular from −1 to +1 mm, preferably from −0.5 to +0.5 mm. Here, "+" indicates an overlapped state, and "−" indicates a non-overlapped state.

The center portion 12, used for supporting and transporting toner, only needs to be subjected to a surface treatment adopted in the conventional hard-roller-type developing roller, and is subjected to, for example, a surface treatment such as a blasting treatment and a resin-coating treatment. With respect to the surface treatment method for the center portion 12, the same surface treatment method as that of the surface processing areas 13 of the two end portions 11 (11*a* and 11*b*) is preferably used.

In the case when the center portion 12 is subjected to a blasting treatment, the surface roughness of the center portion 12 is not particularly limited, and is normally set in the range from 6 to 15 μm, in particular, from 10 to 15 μm. For example, when the surface processing areas 13 correspond to the blast-treated areas, the surface roughness of the center portion is normally set to 1 to 2 times higher than the surface roughness of the surface processing areas 13. The blasting treatment on the center portion 12 can be carried out in the same method as the blasting treatment method of the end portions 11.

In the case when the center portion 12 is subjected to a resin coating treatment, with respect to the surface height of the center portion 12, although not particularly limited, a resin coating layer having a thickness normally set in the range from 5 to 30 μm, in particular, from 10 to 20 μm is formed. In particular, when the surface processing areas 13 correspond to the resin-coated areas, the surface height of the center portion is normally set to substantially the same as that of the surface processing areas 13 from the viewpoint of manufacturing costs.

The structure of the resin coating layer of the center portion 12 is not particularly limited, and may have the same structure as the resin coating layer that supports toner on the surface thereof and transports the toner in a conventional hard-roller-type developing roller. For example, the following layers may be used: a layer made from only a resin, a layer made by dispersing additives such as roughness-providing particles and a conductive substance in a resin, and a layer having an over-coating layer used for applying a low friction property and a peeling preventive property as its resin layer and the like. The resin coating treatment onto the center portion 12 can be carried out by the same method as the resin coating treatment method for the end portions 11. The resin, solvent, applying method and conditions and the like to be used are the same as those of the resin coating treatment for the end portions 11.

In the case when the center portion 12 is subjected to the resin coating treatment, each of the border portions of the center portion 12 in the resin coating layer to the other areas 16 is preferably made to have a slope so as to allow the layer thickness to become gradually thinner as it comes closer to the border. With this structure, when an attempt is made to return toner that has entered the gap between the developing roller and the sealing member to the direction toward the center portion 12, the toner is allowed to return to the center portion comparatively easily.

Figure 6:
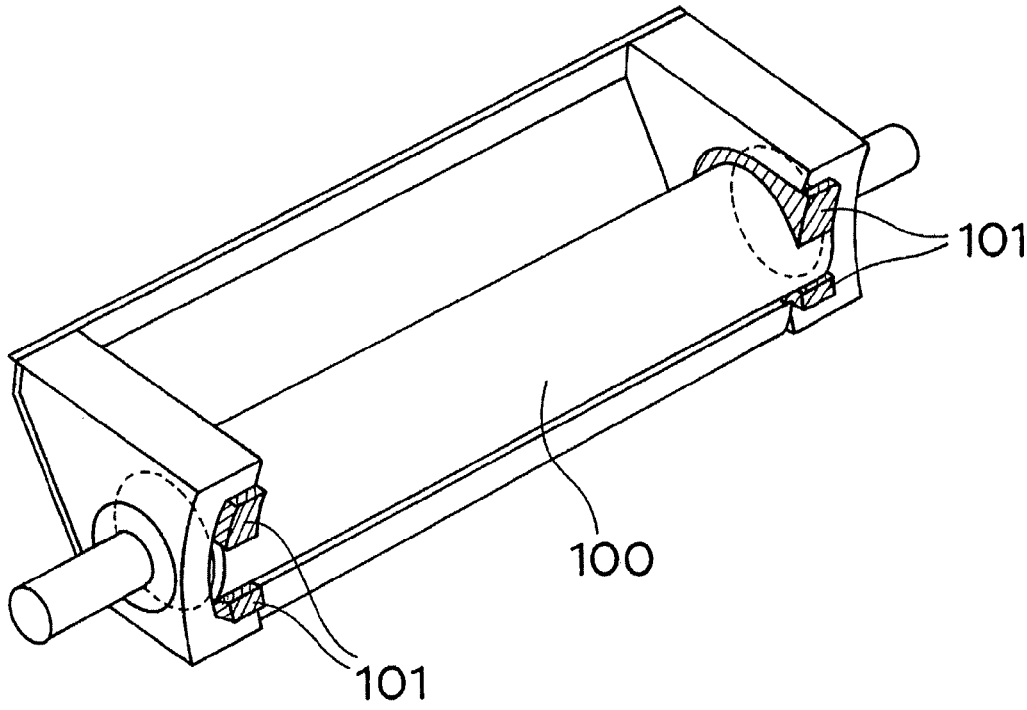
FIG. 6 is a schematic sketch that shows one example of a conventional developing apparatus.

With respect to the sealing member, those members that are made in contact with the two end portions of the developing roller and conventionally used for preventing toner leakage in the field of the developing apparatus may be used. Specific examples thereof include the following members: a member having a shape as shown in 101 of FIG. 6, made of a foamed material, a film shaped member, and a sheet-shaped member with fine hair attached to the surface, such as hair transplanted paper and the like. In particular, the sealing member having a film shape is cut into stripes, and used in a manner so as to be wrapped along each of the end portions of the developing roller.

With respect to the other members and devices possessed by the developing device of the present invention, such as a regulating blade 2, toner 3, a developing vessel 4 and a supplying roller 5, not particularly limited, those known members and devices conventionally used in a mono-component developing device may be used.

For example, with respect to the toner, a toner that contains toner particles manufactured through a wet method, such as a polymerization method, may be used, or a toner that contains toner particles manufactured by a pulverizing method (dry method) may be used.

Not particularly limited, the average particle size of the toner is preferably set to 7 μm or less, in particular in the range from 4.5 μm to 6.5 μm. The average circularity of the toner is preferably set in the range from 0.94 to 0.99, in particular from 0.95 to 0.97. Normally, as the average particle size of the toner becomes smaller and as the average circularity becomes higher, the possibility of occurrence of toner leakage becomes higher; however, in the present embodiment, even in the case of such a particle size and an average circularity, it is possible to effectively prevent the problem of toner leakage.

The average particle size of toner is given as a value measured by using a Coulter Counter (made by Beckman Coulter Co., Ltd.).

The circularity of the toner is given as a value measured by an FPIA-2100 (made by Sysmex Corporation).

EXAMPLES

Example A

Blasting Process

Examples/Comparative Examples

Production of Developing Roller

A center portion 12 and two end portions 11*a* and 11*b* of the outer surface of each of core metal shafts, made of aluminum, having an outer diameter of 16 mm (236.8 mm in length in the axis direction) were subjected to blasting treatments by using a mask. As a result, each of developing rollers, which has blast-treated areas having a spiral shape on its circumferential face of each of the two end portions, with a blast-treated area serving as a toner transporting area being formed on the circumferential face of the center portion, was obtained. Each of the developing rollers had the same overall shape as the shape shown in FIG. 2, except that the spiral shape of the surface processing areas 13 thereof was different. The surface shape, dimension and the like of the respective portions are shown in the Table. In any of the developing rollers, the other area 16 in each of the two end portions 11*a* and 11*b* had an untreated mirror face, with a surface roughness of 0.8 μm.

In Comparative Example 1A, the entire face of each of the two end portions 11*a* and 11*b* was evenly subjected to a blasting treatment.

(Evaluation)

Each of the developing rollers was installed into a magicolor 5430 (made by Konica Minolta Holdings, Inc.) having a structure as shown in FIG. 1, and endurance printing processes of 10,000 sheets were carried out. Thereafter, the inside of the machine was observed so that evaluations of toner leakage from the developing apparatus and toner fusion between the developing roller and the sealing member were carried out. The average particle size of the toner was 6.3 μm, and the average circularity was 0.965. In Examples A1 to A16, the driving torque of the developing roller was the same as that in the case of using a developing roller as a standard equipment of the above-mentioned printer.

5: No toner leakage occurred, without causing toner fusion;

4: No toner leakage occurred, with slight toner fusion;

3: Toner leakage slightly occurred, and toner fusion also occurred; however, no problem was caused in practical use;

2: Toner leakage occurred, and toner fusion also occurred, resulting in problems in practical use; and 1: A large amount of toner leakage occurred, and toner fusion also occurred.

shape shown in FIG. 2, except that the spiral shape of the surface processing areas 13 thereof was different. The surface shape, dimension and the like of the respective portions are shown in the Table. In any of the developing rollers, the other area 16 in each of the two end portions 11*a* and 11*b* had an untreated mirror face.

In Comparative Example 1B, the entire face of each of the two end portions 11*a* and 11*b* was evenly subjected to a resin-coating treatment.

The resin-coating treatments on the two end portions and the center portion of the developing roller were carried out in accordance with the following method.

The core metal shaft was spray-coated with a primer solution with a thickness of 0.5 mg/cm$^2$, and this was air-dried. Thereafter, a surface coating solution was applied by spray—thereon so that the thickness of the surface coating layer after an urethane reaction was set to a predetermined value, and after having been air-dried, this was heated at 140° C. for 60 minutes; thus, a developing roller was obtained.

(Preparation of Primer Solution)

To 100 parts by weight of a silane coupling agent (KBP-44; made by Shin-Etsu Chemical Co., Ltd.) was added 1 part by weight of Ketchen Black (made by Lion Corporation) as an additive, and this was further diluted by adding 300 parts by weight of isopropyl alcohol thereto so that a primer solution was prepared.

(Preparation of Surface-Coating Solution)

To 100 parts by weight of fluorine-containing polyol (Zeffle, made by Daikin Industries, Ltd.) and 8 parts by weight of conductive carbon black (made by Cabot Corporation) was added 300 parts by weight of butyl acetate, and dispersed by using a disperser. To this dispersion solution was added 50 parts by weight of reactive silicone oil with two carbinol-modified terminals (X-22-16-AS; made by Shin-Etsu Chemical Co., Ltd.) and stirred to prepare a main coating agent. To this main agent was added urethane-modified hexamethylene diisocyanate (Duranate, made by Asahi Kasei Corporation) serving as a curing agent so that equivalent of the hydroxyl group in the main agent and equivalent of the isocyanate group in the curing agent may become 1:1; thus, a surface-coating solution was prepared.

TABLE 1

| | Surface processing area (13) | | | | | | | Sealing | Center portion (12) | |
|---|---|---|---|---|---|---|---|---|---|---|
| | θ (°) | Number of the areas in one end portion | Surface roughness (μm) | m (mm) | n (mm) | q (mm) | r (mm) | member s (mm) | Surface roughness Rz (μm) | Toner leakage |
| Example A1 | 8.2 | 1 | 10 | −1 | 1 | 10 | 6 | 8 | 10 | 5 |
| Example A2 | 9.0 | 1 | 12 | 0 | 2 | 10 | 6 | 8 | 12 | 5 |
| Example A3 | 8.0 | 1 | 8 | +1 | 1 | 10 | 6 | 8 | 15 | 5 |
| Example A4 | 21.2 | 2 | 10 | −1 | 3 | 10 | 6 | 8 | 10 | 4 |
| Example A5 | 15.7 | 2 | 12 | 0 | 1 | 10 | 6 | 8 | 12 | 5 |
| Example A6 | 19.3 | 2 | 8 | +1 | 3 | 10 | 6 | 8 | 15 | 4 |
| Example A7 | 31.0 | 4 | 10 | −0.5 | 1 | 10 | 6 | 8 | 10 | 5 |
| Example A8 | 38.3 | 4 | 12 | 0 | 3 | 10 | 6 | 8 | 12 | 4 |
| Example A9 | 32.7 | 4 | 8 | +0.5 | 2 | 10 | 6 | 8 | 15 | 5 |
| Example A10 | 51.1 | 8 | 10 | −0.5 | 1 | 10 | 6 | 8 | 10 | 5 |
| Example A11 | 57.0 | 8 | 12 | 0 | 2 | 10 | 6 | 8 | 12 | 5 |
| Example A12 | 47.5 | 8 | 8 | +0.5 | 1 | 10 | 6 | 8 | 15 | 5 |
| Example A13 | 13.4 | 1 | 12 | 0 | 2 | 10 | 10 | 8 | 12 | 3 |
| Example A14 | 27.2 | 2 | 12 | +1 | 3 | 10 | 10 | 8 | 12 | 3 |
| Example A15 | 44.7 | 4 | 12 | +0.5 | 2 | 10 | 10 | 8 | 12 | 3 |
| Example A16 | 65.3 | 8 | 12 | −0.5 | 1 | 10 | 10 | 8 | 12 | 3 |
| Comparative Example A1 | — | 0 | 12 | — | — | 10 | 0 | 8 | 12 | 1 |

Experimental Example B

Resin Coating Treatment

Examples/Comparative Examples

Production of Developing Roller

A center portion 12 and two end portions 11*a* and 11*b* of the outer surface of each of core metal shafts, made of iron, having an outer diameter of 16 mm (236.8 mm in length in the axis direction) were subjected to resin coating treatments by using a mask. As a result, each of developing rollers, which has resin-coated areas having a spiral shape on its circumferential face of each of the two end portions, with a resin-coated area serving as a toner transporting area being formed on the circumferential face of the center portion, was obtained. Each of the developing rollers had the same overall shape as the (Evaluation)

The developing roller was evaluated by using the same method as that of Experimental Example A. The driving torque of each of the developing rollers of Examples B1 to B16 was the same as that in the case of using a developing roller as a standard equipment of the above-mentioned printer.

In accordance with the developing roller of the present invention, it is possible to sufficiently prevent toner leakage, with the driving torque of the developing roller being hardly increased. The developing roller of the present invention can be manufactured at low costs, and has a superior durability.

TABLE 2

| | Surface processing area (13) | | | | | | | Sealing member | Center portion | |
|---|---|---|---|---|---|---|---|---|---|---|
| | θ (°) | Number of the areas in one end portion | Thickness (μm) | m (mm) | n (mm) | q (mm) | r (mm) | s (mm) | (12) Thickness (μm) | Toner leakage |
| Example B1 | 8.2 | 1 | 10 | −1 | 1 | 10 | 6 | 8 | 10 | 5 |
| Example B2 | 9.0 | 1 | 15 | 0 | 2 | 10 | 6 | 8 | 15 | 5 |
| Example B3 | 8.0 | 1 | 20 | +1 | 1 | 10 | 6 | 8 | 20 | 5 |
| Example B4 | 21.2 | 2 | 10 | −1 | 3 | 10 | 6 | 8 | 10 | 4 |
| Example B5 | 15.7 | 2 | 15 | 0 | 1 | 10 | 6 | 8 | 15 | 5 |
| Example B6 | 19.3 | 2 | 20 | +1 | 3 | 10 | 6 | 8 | 20 | 4 |
| Example B7 | 31.0 | 4 | 10 | −0.5 | 1 | 10 | 6 | 8 | 10 | 5 |
| Example B8 | 38.3 | 4 | 15 | 0 | 3 | 10 | 6 | 8 | 15 | 4 |
| Example B9 | 32.7 | 4 | 20 | +0.5 | 2 | 10 | 6 | 8 | 20 | 5 |
| Example B10 | 51.1 | 8 | 10 | −0.5 | 1 | 10 | 6 | 8 | 10 | 5 |
| Example B11 | 57.0 | 8 | 15 | 0 | 2 | 10 | 6 | 8 | 15 | 5 |
| Example B12 | 47.5 | 8 | 20 | +0.5 | 1 | 10 | 6 | 8 | 20 | 5 |
| Example B13 | 13.4 | 1 | 15 | 0 | 2 | 10 | 10 | 8 | 15 | 3 |
| Example B14 | 27.2 | 2 | 15 | +1 | 3 | 10 | 10 | 8 | 15 | 3 |
| Example B15 | 44.7 | 4 | 15 | +0.5 | 2 | 10 | 10 | 8 | 15 | 3 |
| Example B16 | 65.3 | 8 | 15 | −0.5 | 1 | 10 | 10 | 8 | 15 | 3 |
| Comparative Example B1 | — | 0 | 15 | — | — | 10 | 0 | 8 | 15 | 1 |

What is claimed is:

1. A mono-component developing apparatus comprising:

a developing roller which transports toner supported on an outer circumferential face of a center portion toward a developing area by rotating in a rotation direction while frictionally sliding on a sealing member on each of two end portions, the developing roller comprising:

surface processing areas having a spiral shape, placed on each of outer circumferential faces of the two end portions, each of the surface processing areas including a first end and a second end, the first end closest to the center portion of the developing roller and the second end closest to an axial end face of the developing roller, and the second end is farther forward in the rotation direction than the first end, wherein an acute angle is made by a spiral direction of each surface processing area and the rotation direction.

2. The mono-component developing apparatus according to claim 1, wherein on the outer circumferential face of each of the two end portions, the surface processing areas having a spiral shape are provided with a surface roughness greater than that of areas on the outer circumferential face other than the surface processing areas or are provided with a surface height that is higher than that of the areas other than the surface processing areas.

3. The mono-component developing apparatus according to claim 2, wherein the surface roughness of the surface processing areas is 3 to 15 μm higher than that of areas other than the surface processing areas.

4. The mono-component developing apparatus according to claim 2, wherein the surface height of the surface processing areas is 5 to 30 μm higher than that of areas other than the surface processing areas.

5. The mono-component developing apparatus according to claim 1, wherein, with respect to the axis direction of the developing roller, supposing that the distance from the end portion of the toner supporting area in the center portion to the end face of the developing roller is q, that the length of each surface processing area having a spiral shape is r, and that the frictional sliding area of the end portion of the developing roller on the sealing member is s, the following relational expression is satisfied:

$$q>s>r.$$

6. The mono-component developing apparatus according to claim 1, wherein the angle is set in the range from 5° or more to 80° or less.

7. The mono-component developing apparatus according to claim 1, wherein the angle is set in the range from 7° or more to 70° or less.

8. A mono-component developing apparatus comprising:

a developing roller which transports toner supported on an outer circumferential face of a center portion toward a developing area by rotating while frictionally sliding on a sealing member on each of two end portions, the developing roller comprising:

surface processing areas having a spiral shape, placed on each of outer circumferential faces of the two end portions, wherein an acute angle is made by a spiral direction of each surface processing area and the rotation direction, and wherein the surface processing areas are blast-treated areas or resin-coated areas.

9. The mono-component developing apparatus according to claim 3, wherein the resin is a fluorine-containing polyurethane resin.

10. A mono-component developing apparatus comprising:

a developing roller which transports toner supported on an outer circumferential face of a center portion toward a developing area by rotating while frictionally sliding on a sealing member on each of two end portions, the developing roller comprising:

surface processing areas having a spiral shape, placed on each of outer circumferential faces of the two end portions, wherein an acute angle is made by a spiral direction of each surface processing area and the rotation direction, and wherein the surface processing area has a surface roughness of 6 to 15 μm.

* * * * *